US007752683B2

(12) United States Patent
Holloway

(10) Patent No.: US 7,752,683 B2
(45) Date of Patent: Jul. 13, 2010

(54) HELMET JACKET

(76) Inventor: Scott M. Holloway, 1927 60th Terrance NE., St. Petersburg, FL (US) 33703

( * ) Notice: Subject to any disclaimer, the term of this patent is extended or adjusted under 35 U.S.C. 154(b) by 549 days.

(21) Appl. No.: 11/856,884

(22) Filed: Sep. 18, 2007

(65) Prior Publication Data

US 2009/0070920 A1 Mar. 19, 2009

(51) Int. Cl.
*A42B 1/24* (2006.01)

(52) U.S. Cl. ..... 2/422; 2/410

(58) Field of Classification Search ..... 2/414, 2/422, 411, 412, 410, 424; 224/643, 580, 224/576, 575
See application file for complete search history.

(56) References Cited

U.S. PATENT DOCUMENTS

| | | | |
|---|---|---|---|
| 1,164,351 | A | 12/1915 | Hultström |
| 1,222,995 | A | 4/1917 | Rhoades |
| 3,668,705 | A | 6/1972 | Garbisch |
| 4,451,933 | A | 6/1984 | Seng et al. |
| 4,887,319 | A | 12/1989 | Daniels |
| D362,085 | S | 9/1995 | Hause et al. |
| 5,732,414 | A | 3/1998 | Monica |
| 6,061,836 | A | 5/2000 | Peters |
| D435,698 | S | 12/2000 | Gill |
| 6,237,162 | B1 | 5/2001 | Gill |
| 6,243,881 | B1 | 6/2001 | Brinkman |
| 6,256,799 | B1 | 7/2001 | McGlasson et al. |
| 6,711,752 | B2 | 3/2004 | Smith |
| 6,848,122 | B1 | 2/2005 | Meeds |

OTHER PUBLICATIONS

Ted's Bell Store (helmets and accessories). http://www.bellhelmets.com (4 pages).
Helmet Covers Etc . . . http://www.helmetcovers.com (24 pages).
Helmet Headz, Headgear with an Edge (Helmet covers) . http://www.helmetheadz.com.

*Primary Examiner*—Katherine Moran
*Assistant Examiner*—Richale L Quinn
(74) *Attorney, Agent, or Firm*—David G. Maire; Beusse Wolter Sanks Mora & Maire, P.A.

(57) ABSTRACT

A helmet jacket for covering and protecting a helmet and for substantially and releasably enclosing the volume inside the helmet to allow the covered helmet to function as a sealed carrying and storage container. The jacket may include elastic segments that define respective constricted openings through which the chin straps of the helmet extend on opposed sides of a releasable fastening element so that the chin straps may be used to carry the helmet while the fastened jacket material substantially encloses the volume inside the helmet to define a storage volume within the helmet.

20 Claims, 3 Drawing Sheets

HELMET JACKET

FIELD OF THE INVENTION

The present invention relates to helmet covers.

BACKGROUND OF THE INVENTION

Helmets are rugged devices that are designed to absorb severe impacts while protecting the wearer's head. However, helmets are also ornamental items that are often fancifully adorned with elaborate paint designs and coveted appliqués. Thus, it is desired to avoid any scarring of a helmet during manual transportation of the helmet, such as when carrying the helmet while traveling in a car or airplane. U.S. Pat. No. 6,711,752 describes a cover for encompassing and protecting a helmet. A helmet cover may also present various decorative, ornamental, or informational designs, such as shown in U.S. Pat. No. 6,243,881.

BRIEF DESCRIPTION OF THE DRAWINGS

The invention is explained in the following description in view of the drawings that show.

DETAILED DESCRIPTION OF THE INVENTION

The present inventor has recognized that when a helmet wearer is manually transporting a helmet, he or she will usually carry additional items such as eye goggles, gloves, music players and related equipment (mp3, etc.), keys, cell phones, sunglasses, money, identification, etc. The present inventor has innovatively developed the present invention not only to protect a helmet during manual transportation, but also to transform the helmet into a portable storage space. When a helmet is inserted into the claimed helmet jacket, users can store valuables in the sealable enclosure established by the jacket within the confines of the padded helmet volume, thereby protecting items from damage, theft, precipitation, and loss. The present invention makes effective use of a heretofore insecure and generally wasted space within the helmet, and it can eliminate the need for the user to carry a second container, such as a purse or bag. The invention also makes effective use of the helmet chin straps to facilitate grasping or hanging the assemblage.

Figure 1:
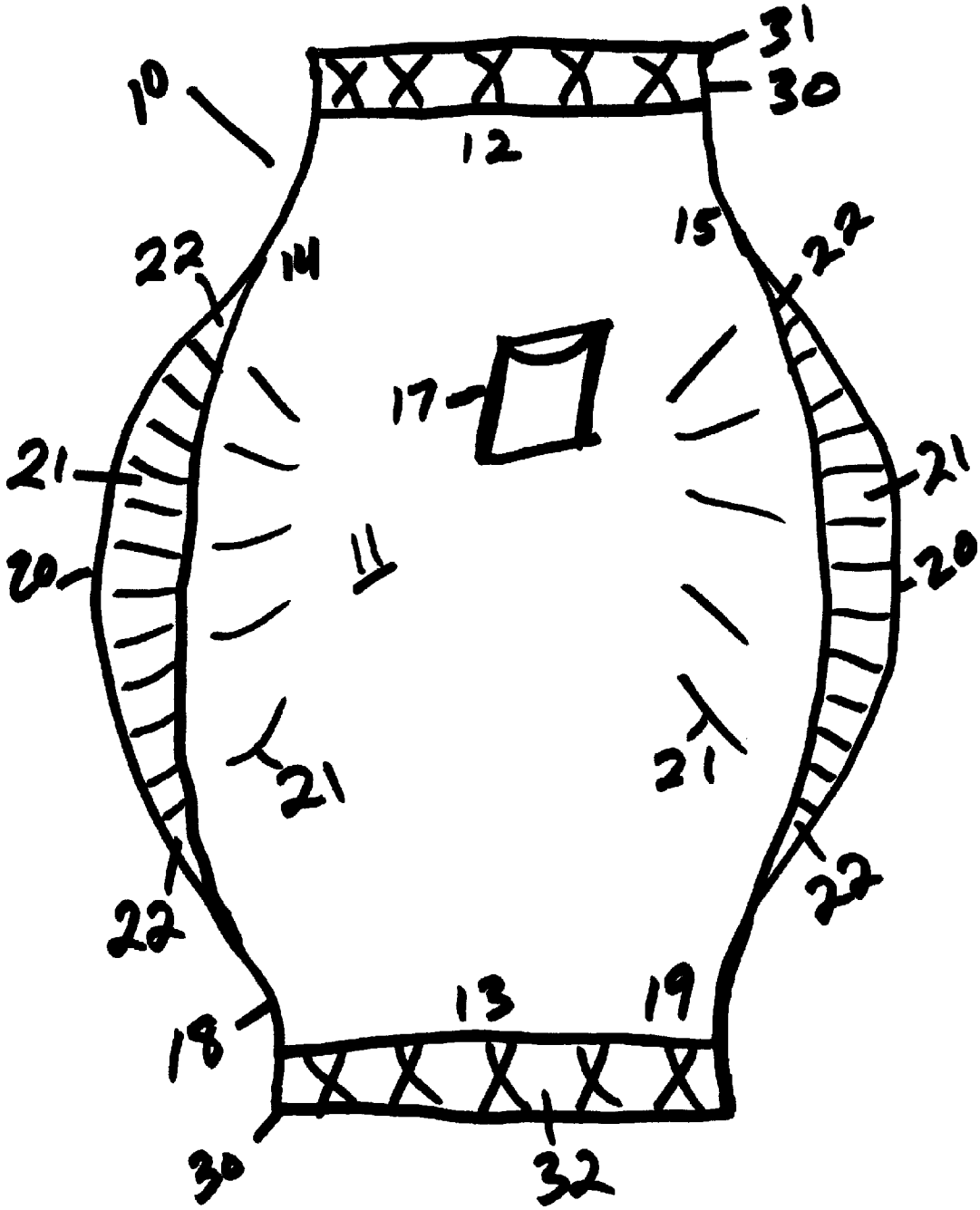
FIG. 1 is a plan view of a helmet jacket showing the inside helmet-contacting surface.
Figure 2:
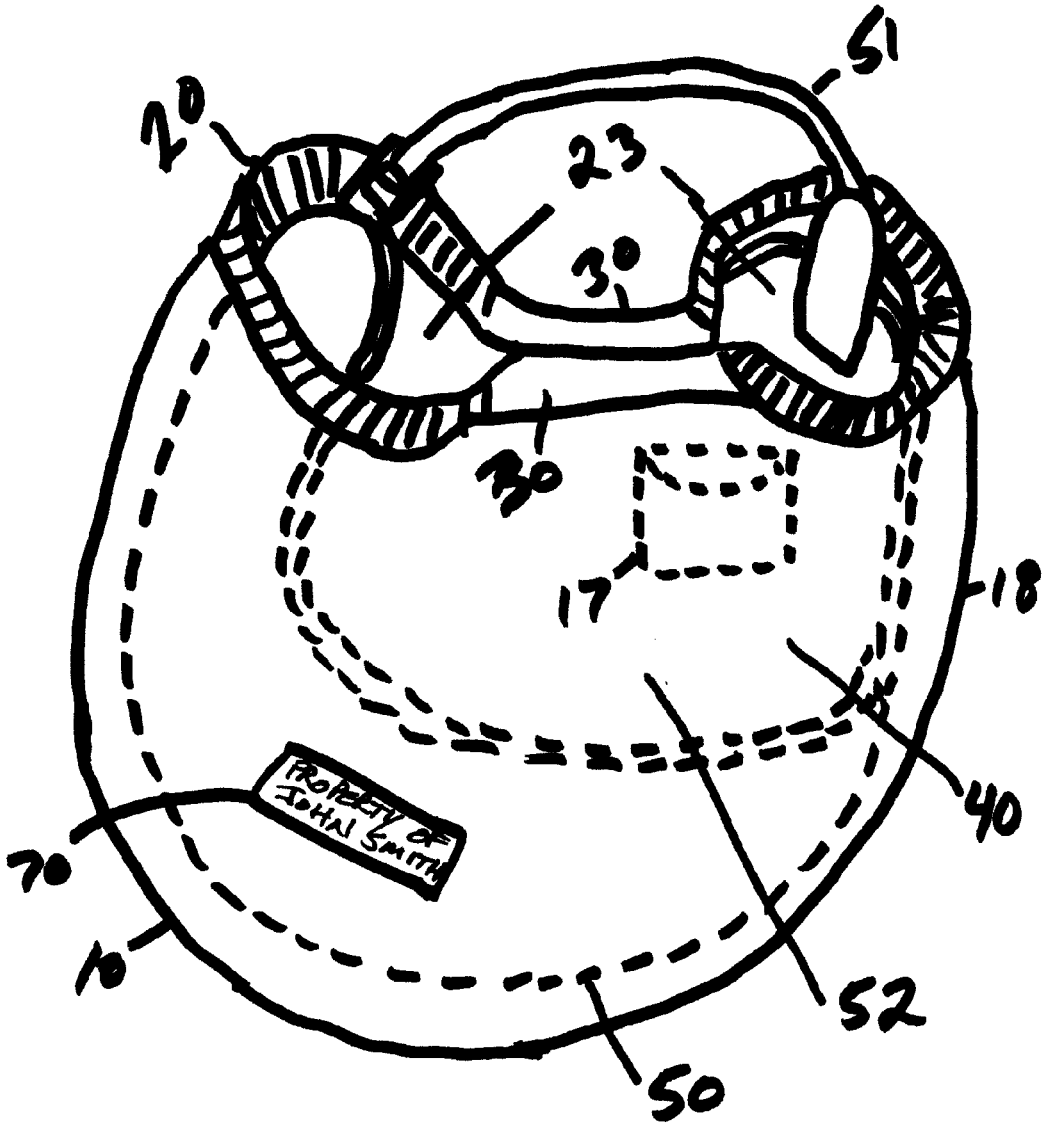
FIG. 2 is a view of a helmet encased with the helmet jacket of FIG. 1 showing the outside surface of the jacket.

Referring now to the drawings, the present invention provides a helmet jacket 10 for enclosing and protecting a helmet 50. As shown in FIGS. 1 and 2, the helmet jacket 10 is comprised of a helmet cover material 11 having an upper section 12, a lower section 13, a first side section 14, and a second side section 15, an inner side 19, and an outer side 18. The cover material 11 may be cotton, polyester, or other suitable material and can be composed of a flexible or expandable fabric. The cover material fabric can include padding to help protect the helmet 50 from damage, such as chipping, if dropped. The cover material fabric can include metal interlacing or metal mesh to increase its strength if desired. The cover material 11 can conform to the helmet's shape in a form fitting manner or it may have a somewhat loose fit, thereby allowing the helmet jacket 10 to be used with virtually any helmet shape. The cover material 11 can include indicia 70 such as decorative designs, lettering, graphic designs, or photographs on the outer side 18. The cover material 11 can include a pouch 17 which can be attached to the inner side 19 or the outer side 18 of the cover material 11.

The helmet 50 can include a connectable chin strap 51 secured to opposed sides of the helmet 50 and extending away from the helmet 50. The helmet 50 includes a neck opening 52 where the wearer's neck is generally positioned while wearing the helmet 50.

Referring to FIG. 1, elastic segments 20 on the cover material 11 may be formed at the first side section 14 and the second side section 15. The elastic segments 20 can be created using methods such as creating folds 21 in the cover material 11 in a rippled pattern. Additionally an elastic band 22 can be inserted into the folds 21 to enhance the elasticity of the folds 21. The elastic bands 22 may be rubber inserts, draw strings, folded material, or springs in various embodiments. The elastic segments 20 function to gather the respective side section of the jacket 10 around the respective end of the helmet chin straps 51, as shown in FIG. 2.

Figure 3:
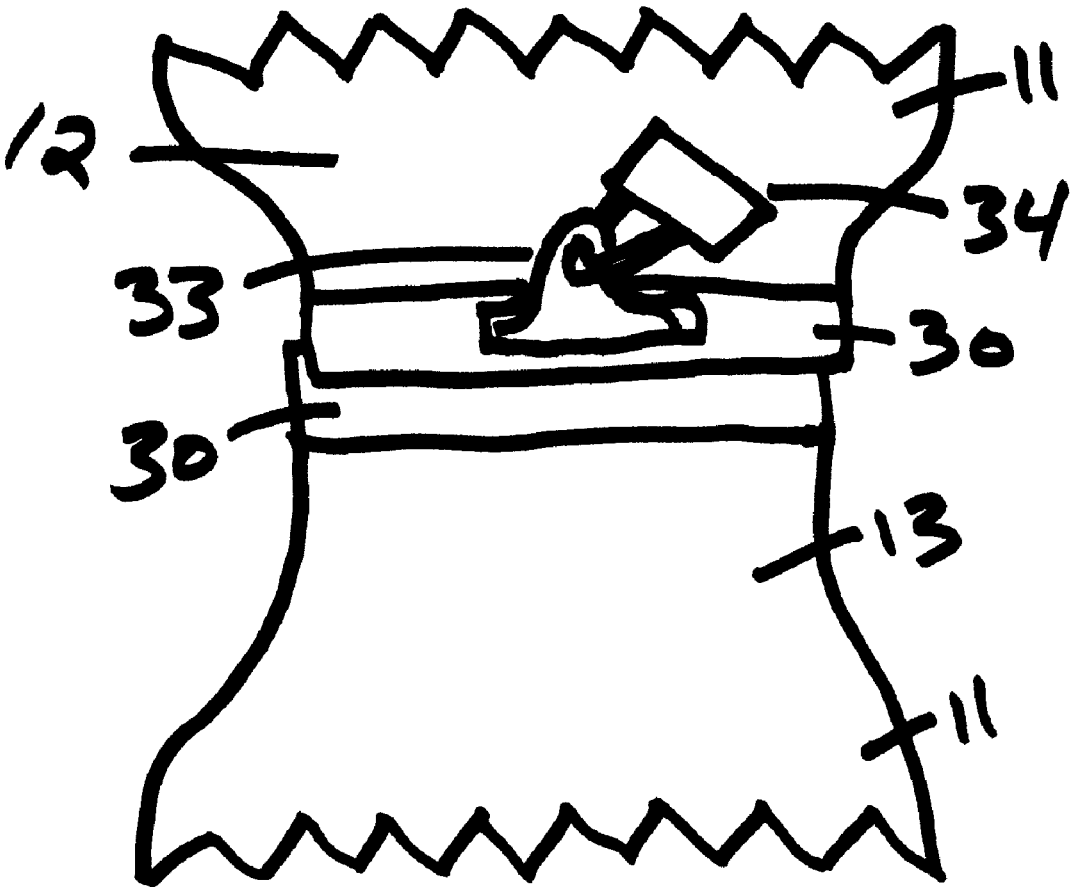
FIG. 3 is a lock and locking clasp fastening element arrangement as may be used for one embodiment of a helmet jacket.

Fastening elements 30 are shown formed at the upper section 12 and the lower section 13 of the cover material 11. The fastening elements 30 may be of any known type, such as hook and loop fasteners, snap fasteners, zipper elements, buckle elements, draw strings, magnets, and locking members. Opposed portions of the fastening elements 30 on the upper section 12 and lower section 13 are separated to allow the helmet 50 to be inserted into the jacket 10, and then are fastened together to allow the elastic segments 20 to gather around the respective chin strap 51 ends, thereby substantially enclosing the volume inside the helmet 50. The fastening element 30 may include locking members such as a lock 34 and locking clasp 33, as shown in FIG. 3. The fastening elements 30 releasably secure the upper 12 and lower section 13 together to allow selective access to the interior of the helmet 50.

The ability to securely fasten the upper and lower section of the cover material 11 together provides unique security features heretofore not found in helmet covers. For example, as shown in FIG. 3, when using locking members such as a lock 34 and locking clasp 33 as the fastening elements 30 used to join together the upper and lower sections (12 and 13 respectively) of cover material 11, unauthorized wearing of the helmet 50 can be prevented or deterred. With the fastening elements 30 locked together, the helmet neck opening 52 is securely closed off, as shown in FIG. 2, and the helmet cannot be worn. Where the cover material 11 is made of interlaced metal or metal mesh, the enclosed volume and stored items are hidden from view and secured from pilferage.

As shown in FIG. 2, when the cover material's upper section fastening element 31 and lower section fastening element 32 are joined together, the elastic segments 20 constrict, forming respective constricted openings 23 on opposing sides of the joined fastening elements 30, and the cover material 11 forms an enclosure 40 for substantially encasing the helmet 50. The helmet chin straps 51 may protrude through the constricted openings 23 to function as a grasping element.

When the cover material pouch 17 is attached to the outer side 18 or external surface of the cover material 11, the pouch 17 remains external to the enclosure 40. This provides quick access to items in the pouch 17 without the need to reopen the enclosure 40. Alternatively, when the pouch 17 is attached to the inner side 19 of the cover material 11, the pouch 17 is positioned within the enclosure 40. When a helmet 50 is within the enclosure 40, the pouch 17 provides a storage pocket positioned between the helmet 50 and the inner cover material 11.

The helmet jacket can be used with a wide range of helmets such as motorcycle helmets, race car helmets, skiing and snow boarding helmets, cycling helmets, skating helmets, hockey helmets, football helmets, baseball helmets, softball helmets, construction helmets, etc.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A helmet jacket for substantially enclosing and protecting a helmet, the helmet including chin straps secured to opposed sides of the helmet and extending away from the helmet, the helmet jacket comprising:

a cover material comprising an upper section, a lower section, a first side section, and a second side section, the cover material defining an enclosure;

an elastic segment formed at each of the first side section and the second side section; and cooperating fastening elements formed at the upper section and the lower section;

wherein when the fastening elements are disengaged from each other the enclosure is opened to receive the helmet; and wherein when the fastening elements are engaged with each other with the helmet in the enclosure, the elastic segments define respective constricted openings through which the chin straps of the helmet extend on opposed sides of the joined fastening elements, and the cover material substantially closes the enclosure to define a storage volume within the helmet.

2. The helmet jacket according to claim 1, wherein the fastening elements are selected from the group of hook and loop fasteners, snap fasteners, zipper elements, buckle elements, draw strings, magnets, locking members, and locking clasps.

3. The helmet jacket according to claim 2, wherein the fastening elements comprise a locking clasp and lock.

4. The helmet jacket according to claim 1, wherein the cover material is padded.

5. The helmet jacket according to claim 1, wherein the elastic segments are selected from the group of rubber inserts, draw strings, folded material, and springs.

6. The helmet jacket according to claim 1, further comprising a pouch attached to the cover material.

7. The helmet jacket according to claim 6, wherein the pouch is positioned within the enclosure when the fastening elements are joined together.

8. The helmet jacket according to claim 6, wherein the pouch remains external to the enclosure when the fastening elements are joined together.

9. The helmet jacket according to claim 1, wherein the cover material comprises an elastic material and conforms to a shape of the helmet.

10. A combination comprising:

a helmet comprising chin straps;

a cover material comprising an upper section, a lower section, a first side section, and a second side section;

an elastic segment formed at the first side section and at the second side section;

fastening elements formed at the upper section and the lower section; and wherein when the upper section fastening element and the lower section fastening element are joined together around the helmet, the elastic segments define respective constricted openings on opposed sides of the joined fastening elements, the chin straps protrude through the respective constricted openings, and the cover material forms an enclosure substantially encasing the helmet and defining a substantially sealed storage volume therein.

11. The combination according to claim 10, wherein the fastening elements are selected from the group of hook and loop fasteners, snap fasteners, zipper fasteners, buckle fasteners, draw strings, magnets, locking members, and locking clasps.

12. The combination according to claim 11, wherein the fastening elements comprise a locking clasp and lock.

13. The combination according to claim 10, wherein the cover material is padded.

14. The combination according to claim 10, further comprising a pouch attached to the cover material.

15. The combination according to claim 14, wherein the pouch is positioned within the enclosure when the fastening elements are joined together.

16. The combination according to claim 14, wherein the pouch remains external to the enclosure when the fastening elements are joined together.

17. The combination according to claim 10, wherein the elastic segments are selected from the group of rubber inserts, draw strings, folded material, and springs.

18. An apparatus for enclosing and protecting a helmet comprising:

a cover material;

an elastic material attached at first and second side sections of the cover material;

means for releasably fastening together an upper and lower section of the cover material;

wherein when the means for releasably fastening is disengaged, the elastic material may be stretched to receive a helmet into an enclosure defined by the cover material; and wherein when the means for releasably fastening is thereafter engaged with the helmet within the enclosure, the helmet is substantially encased in the cover material, the elastic material defines opposed constricted openings for the passage of respective chin straps of the helmet with the enclosure being substantially closed for defining a storage volume.

19. The apparatus for enclosing and protecting a helmet according to claim 18, further comprising a pouch attached to the cover material.

20. The apparatus for enclosing and protecting a helmet according to claim 18, wherein the means for releasably fastening are selected from the group of hook and loop fasteners, snap fasteners, zipper fasteners, buckle fasteners, draw strings, magnets, locking members, and locking clasps.

* * * * *